US006139657A

United States Patent [19]

Barclay et al.

[11] Patent Number: 6,139,657

[45] Date of Patent: Oct. 31, 2000

[54] FORMATION OF A ZIRCONIUM-BERYLLIUM EUTECTIC LAYER ON A ZIRCONIUM ALLOY SUBSTRATE OR A TITANIUM-BERYLLIUM EUTECTIC ON A TITANIUM ALLOY SUBSTRATE

[75] Inventors: Ronald Stewart Barclay; Jeffry James Temple; Michael D. Gabbani, all of Peterborough, Canada

[73] Assignee: General Electric Canada Inc., Mississauga, Canada

[21] Appl. No.: 09/008,489

[22] Filed: Jan. 16, 1998

(Under 37 CFR 1.47)

[51] Int. Cl.[7] ..... C23C 10/28

[52] U.S. Cl. ..... 148/512; 148/527; 428/649; 428/660

[58] Field of Search ..... 148/281, 512, 148/527, 537; 428/649, 660

[56] References Cited

U.S. PATENT DOCUMENTS

| | | | |
|---|---|---|---|
| 3,680,201 | 8/1972 | McGregor | 428/660 |
| 4,034,906 | 7/1977 | Carlson et al. | 428/660 |

*Primary Examiner*—George Wyszomierski
*Attorney, Agent, or Firm*—Edward H Oldham

[57] ABSTRACT

This invention relates to the production of a useful eutectic layer formed on a zirconium alloy or a titanium alloy substrate. The layer is formed by the surface contact with a beryllium strip being held in intimate contact with the surface of the zirconium or titanium alloy substrate while the zirconium or titanium alloy and the contacting beryllium strip are heated in an inert atmosphere to a temperature which is above the eutectic melting point and is held constant at that temperature for a predetermined time. At the prescribed time, the materials are allowed to cool and the beryllium strip is "removed" from the "surface" of the zirconium or titanium alloy substrate and the newly formed zirconium-beryllium or titanium-beryllium alloy eutectic is formed in the surface of the zirconium or titanium alloy substrate.

6 Claims, 5 Drawing Sheets

FORMATION OF A ZIRCONIUM-BERYLLIUM EUTECTIC LAYER ON A ZIRCONIUM ALLOY SUBSTRATE OR A TITANIUM-BERYLLIUM EUTECTIC ON A TITANIUM ALLOY SUBSTRATE

BACKGROUND OF THE INVENTION

In the manufacture of various components of a nuclear and aerospace industries, it is often necessary to form a eutectic layer on a zirconium or titanium alloy part. In the past, a suitable eutectic layer has been formed by initially forming a film of beryllium on the substrate by vapour deposition of beryllium on the surface of the zirconium or titanium alloy substrate in a vacuum furnace. The coated substrate is then heated in a preselected atmosphere to cause the formation of a eutectic layer with the surface layer of the substrate. The surface of the zirconium or titanium must be scrupulously cleaned beforehand to yield the production of an acceptable eutectic layer.

Because of the extreme toxicity of beryllium vapour, the avoidance of the vapour deposition step in the production of the eutectic layer is most attractive to the industry.

Therefore, it is an object of this invention to produce an acceptable layer of a zirconium-beryllium eutectic on a zirconium alloy substrate or a titanium-beryllium eutectic on a titanium alloy substrate, in the absence of the production of a beryllium vapour.

It is the object of this invention to produce a zirconium-beryllium eutectic layer on the surface of a zirconium alloy part or a titanium-beryllium eutectic layer on the surface of a titanium alloy part without prior extreme surface preparation of the zirconium or titanium alloy substrate.

Before proceeding further, it will be found that this invention will describe the formation of a zirconium-beryllium eutectic on a zirconium alloy substrate. The process applies equally well to the formation of a titanium-beryllium eutectic on a titanium alloy substrate. The description will describe only the production of the zirconium-beryllium eutectic, it being understood that the process applies equally well to the production of the titanium-beryllium eutectic.

It is another object of this invention to produce a zirconium-beryllium eutectic layer on a zirconium alloy substrate, the depth of which may be controlled to very precise limits by controlling the temperature and time the components are in the heated condition.

It is another object of this invention to permit the use of a bar or strip of beryllium in the production of the zirconium-beryllium eutectic layer instead of more costly forms of beryllium required for some types of eutectic production.

It is another object of this invention to produce an acceptable zirconium-beryllium layer on a zirconium alloy substrate where virtually all the beryllium which leaves the donor beryllium element ends up in the eutectic beryllium-zirconium layer and not on the associated equipment used in the enclosure and the associated heating equipment.

It is another object of this invention to avoid the use of sophisticated equipment associated with prior art production methods, and the associated complex control apparatus used to produce an acceptable eutectic layer.

It is an object to produce a zirconium-beryllium eutectic layer on a zirconium alloy substrate in a very efficient economical manner.

It is another object of this invention to avoid the costly waste handling processes associated with previous methods of formation of layers of zirconium-beryllium eutectics.

SUMMARY OF THE INVENTION

These and other objects apparent from the following detailed description taken in association with the accompanying drawings are attained by providing a strip or bar of beryllium which is held in good surface contact with a zirconium alloy substrate such that the two parts may be heated in a controlled manner in a furnace where the atmosphere may be controlled. After a predetermined temperature above the eutectic melting point is reached and held for some predetermined time, the parts are allowed to cool whereupon the bar or strip of beryllium may be "removed" from the surface of the zirconium alloy substrate, revealing the newly formed zirconium-beryllium eutectic layer. The depth of the eutectic layer may be precisely controlled by control of the temperature and time duration of the heated condition.

DESCRIPTION OF THE PREFERRED EMBODIMENT

Figure 1:
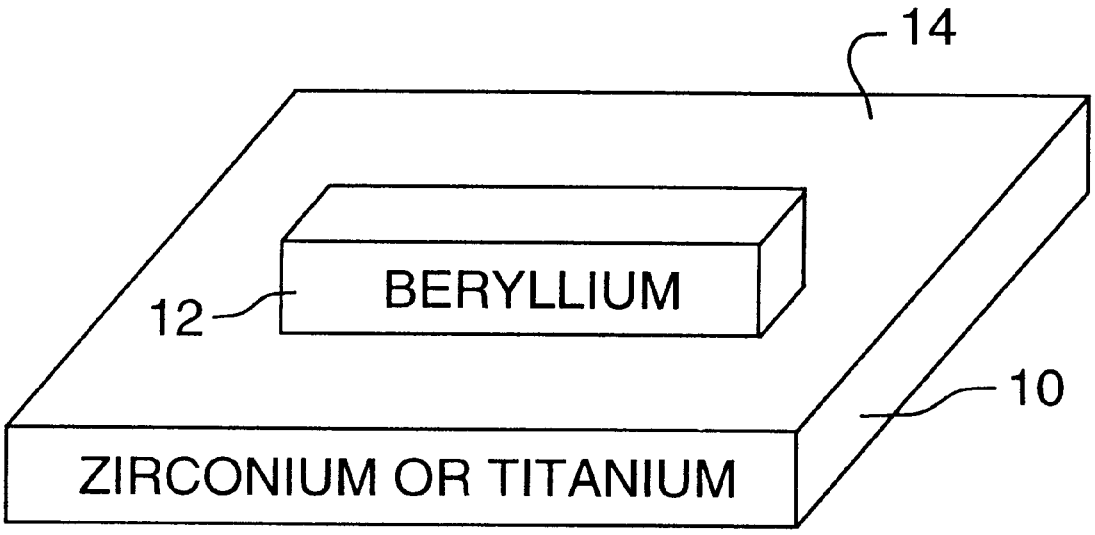
FIG. 1 is an illustration of the components of this invention.

Referring to FIG. 1, a zirconium alloy substrate 10 is shown having a bar of beryllium 12 laid upon the surface thereof. The top surface 14 of the zirconium alloy substrate is previously cleaned by wiping with a suitable solvent in this instance alcohol. The beryllium bar 10 has its mating surface wiped clean, but the invention will function without elaborate surface preparation of either the beryllium bar 12 or the zirconium substrate 10.

The substrate 10 and the contacting beryllium bar are placed in a suitable furnace where the atmosphere may be controlled. In this instance, the eutectic formation process was carried out in a furnace using an argon atmosphere. The substrate and bar were subjected to various temperatures in excess of the eutectic melting point for various periods of time.

Figure 2:
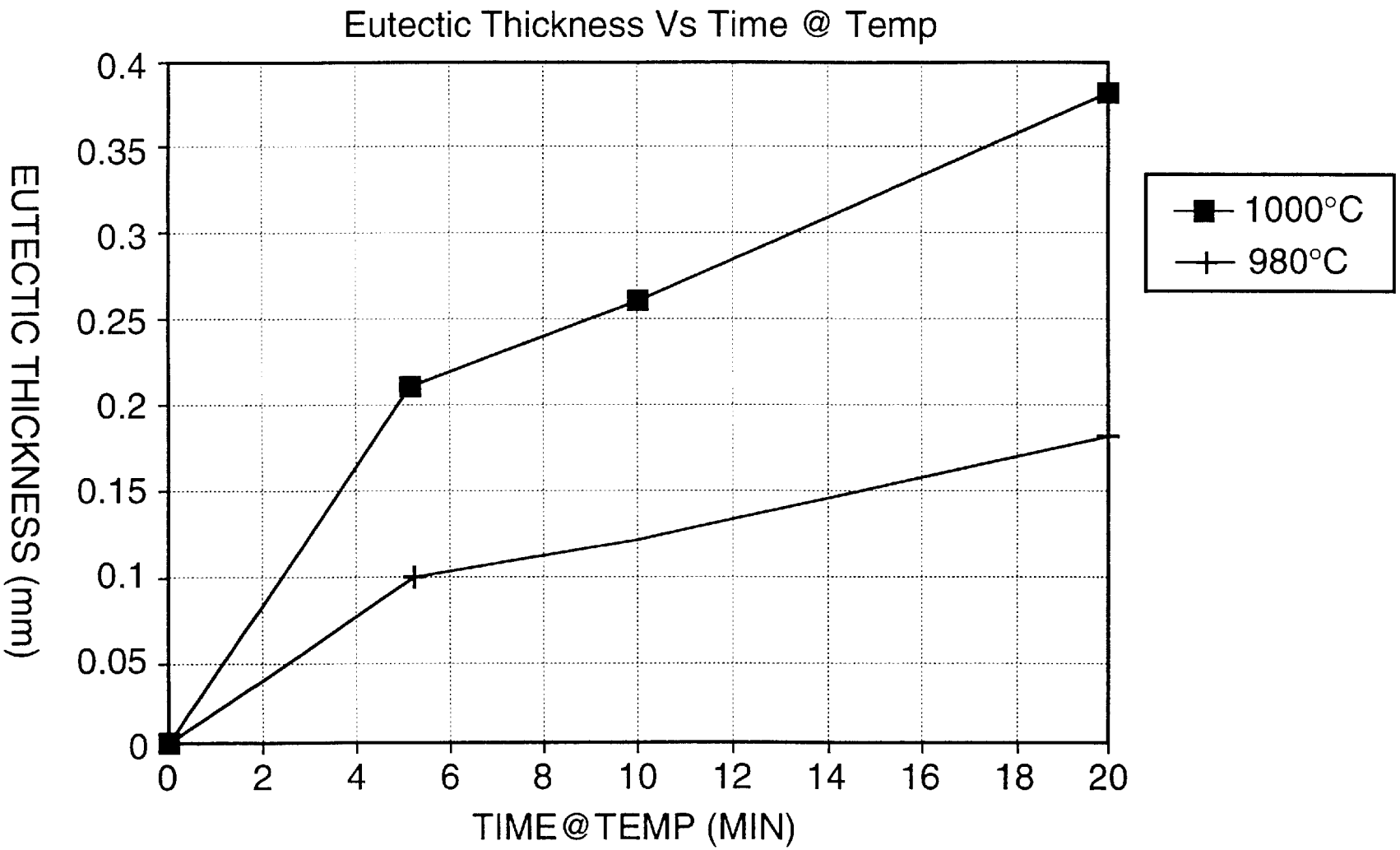
FIG. 2 is a table showing the production of a eutectic layer at two temperatures vs time.

FIG. 2 shows the variation in the thickness of the eutectic layer for furnace temperatures of 1000° C. and 980° C. for various time duration in which the contacting beryllium and zirconium substrate are exposed to the two temperatures.

The depth of the eutectic layer is controllable to fairly close tolerances by controlling the temperature to which the two components are exposed, and the time duration will also be found to have a pronounced predictable effect on the depth of the eutectic layer formed in the zirconium substrate.

When the zirconium substrate and its contacting beryllium strip have been subjected to the selected furnace conditions for a preselected time, the pair are allowed to cool and despite the production of the eutectic layer on the zirconium substrate, the beryllium strip or bar separates from the surface of the zirconium substrate. This phenomena is highly unusual in that most metals undergoing a similar process are so tightly "brazed" together that separation is almost impossible.

Figure 3:
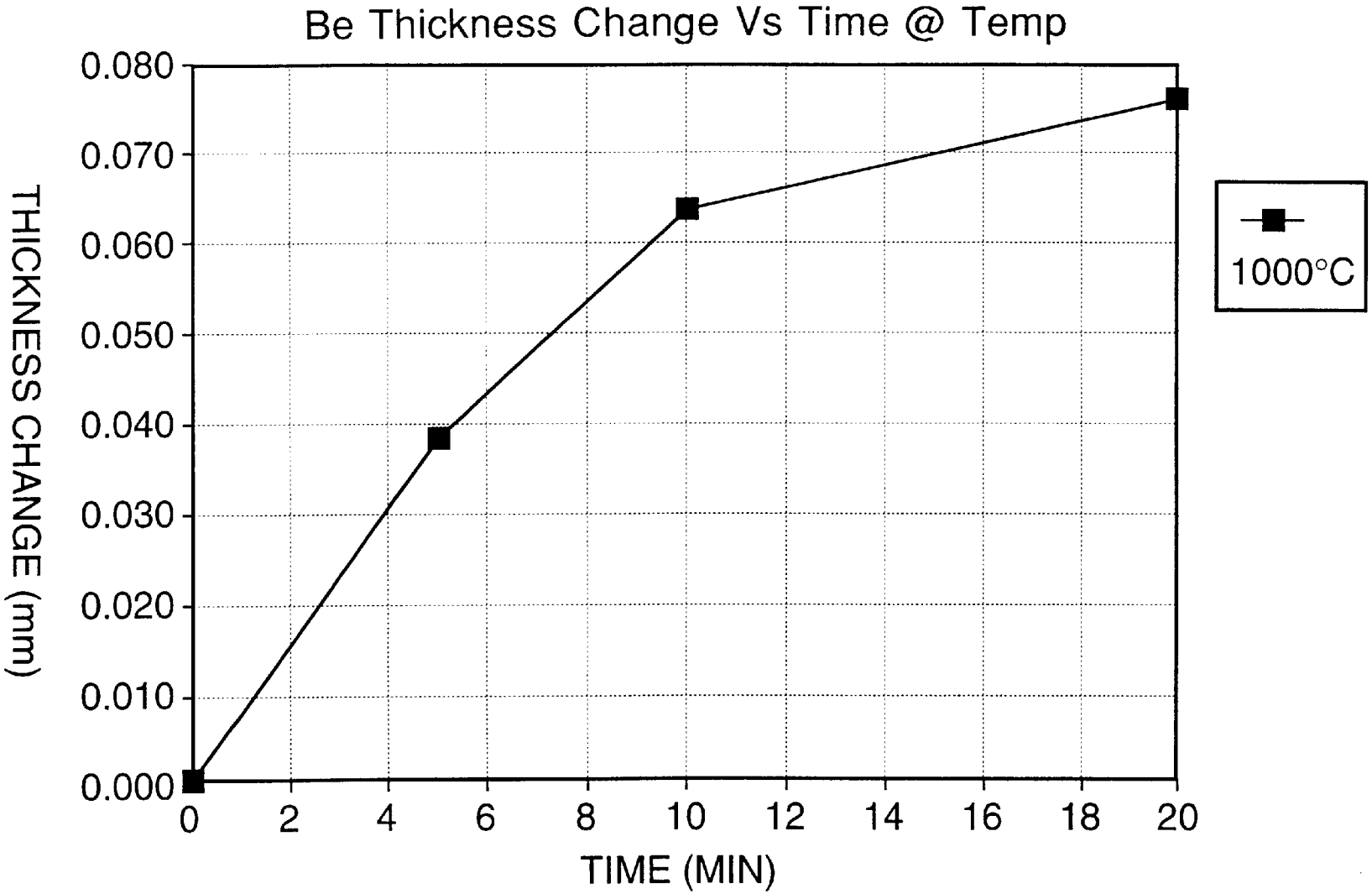
FIG. 3 is a table showing the change in thickness of the beryllium donor strip vs time at a specific temperature.

FIG. 3 is a graph showing the thickness change of the beryllium bar for various timed exposures to the furnace conditions. This provides an indication of the diffusion of the beryllium into the zirconium substrate.

Figure 4:
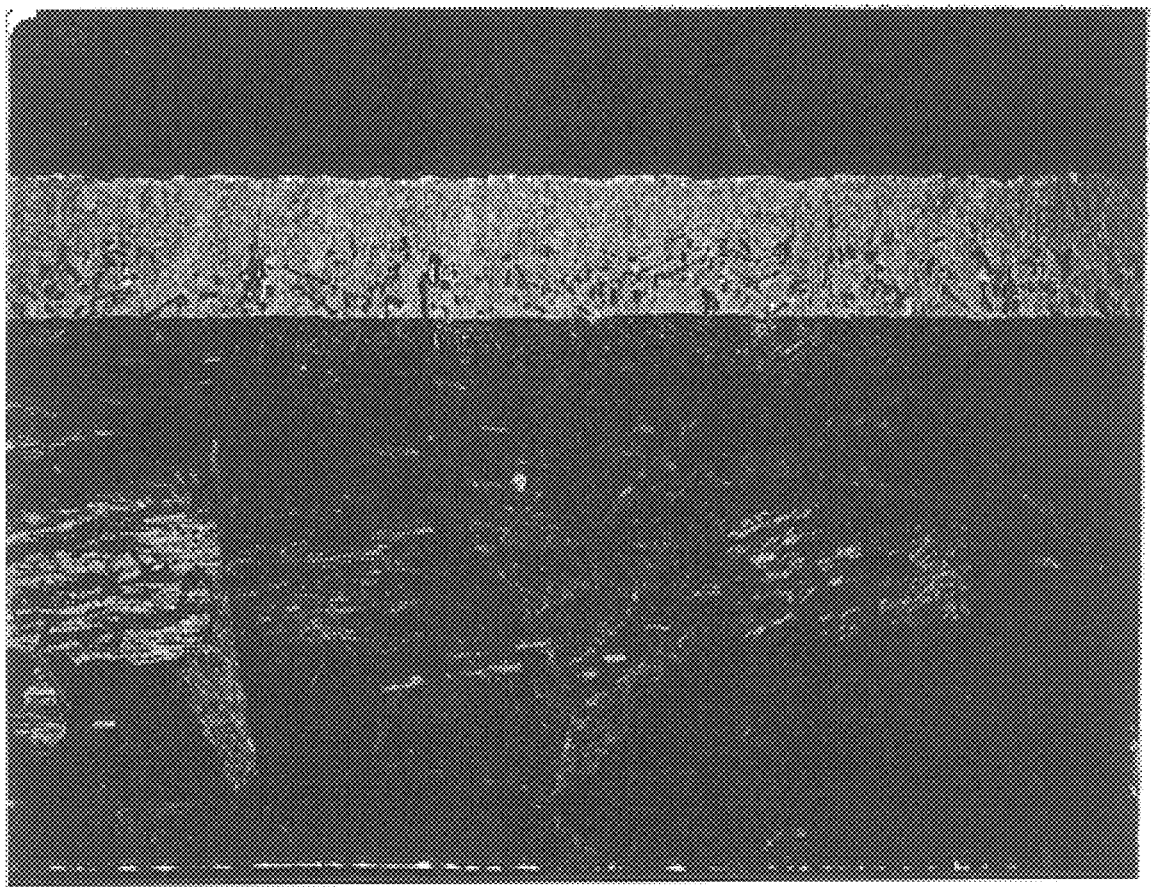
FIG. 4 is a specimen photograph enlargement showing a zirconium-beryllium eutectic layer on a zirconium alloy substrate.

FIG. 4 shows an enlarged section of a specimen showing the eutectic layer of zirconium-beryllium on a zirconium alloy substrate. This sample was produced by exposing the mated beryllium and zirconium alloy substrate to a temperature of 1000° in a vacuum furnace for 10 minutes.

Figure 5:
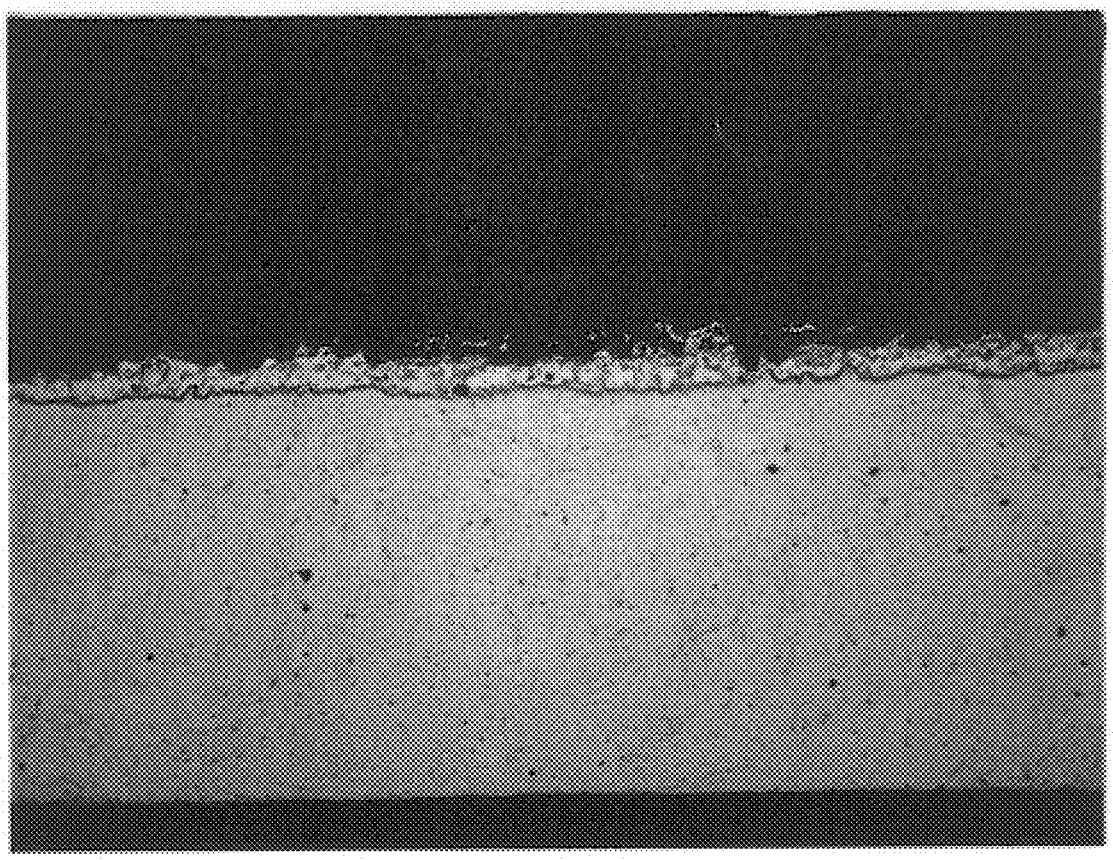
FIG. 5 is a specimen photograph enlargement showing a titanium-beryllium eutectic layer on a titanium alloy substrate.

FIG. 5 shows an enlarged section of a specimen showing the eutectic layer of titanium-beryllium on a titanium alloy substrate. This sample was produced by exposing the mated beryllium and titanium alloy substrate to a temperature of 1060° C. in a vacuum furnace for 7 minutes.

It is thus seen that the production of a layer of the zirconium-beryllium eutectic to a controlled depth is possible under the simplest furnace conditions on the zirconium alloy substrate.

The surface preparation of the two contracting members is straight forward and unsophisticated; the surfaces should be clean, and no special surface preparation is required for either of the components prior to the eutectic production operation.

The thickness of the eutectic layer may be easily controlled by controlling the time duration and the temperature level of the furnace.

The beryllium strip or bar may be easily removed from the zirconium-beryllium eutectic layer upon cooling.

The solid beryllium bar may be reused repeatedly to produce successive eutectic layers with zirconium substrates without any degradation in performance.

The thickness of the solid beryllium bar remaining after a eutectic forming operation is a function of the time and temperature to which the coupled strip and substrate are in contact.

As to the formation of the eutectic layer of titanium-beryllium, the same technique as used with the zirconium alloy substrate will produce a suitable titanium-beryllium eutectic, except that the eutectic formation temperature for the titanium-beryllium alloy is 1060° C.

It will be found that the eutectic layer can be produced without the risk of producing vapourous beryllium, and the risks of exposure to toxic beryllium vapour is eliminated.

We claim:

1. A method of producing a layer of a zirconium-beryllium eutectic on a zirconium substrate comprising:

providing a body of beryllium, a zirconium substrate, cleaning the surfaces of said body and substrate, mating said body with said substrate so that the previously cleaned surfaces are in engagement, heating said body and substrate in an atmosphere at a temperature in excess of the eutectic melting point for a time sufficient to allow the formation of a zirconium-beryllium eutectic layer on said substrate, cooling said body and substrate to room temperature, separating said body and said substrate.

2. A method of producing a zirconium-beryllium eutectic layer on a zirconium substrate comprising the steps of:

providing a zirconium substrate having at least one cleaned surface, providing a beryllium strip having at least one cleaned surface, mounting said strip on said substrate in a surface engaging relationship so that said cleaned surfaces engage one another, heating said engaged strip and substrate in an atmosphere in a suitable furnace to a eutectic producing temperature for several minutes, cooling said engaged strip and substrate and, removing said strip from said substrate.

3. A method of producing a series of zirconium-beryllium eutectic layers on a zirconium workpiece, comprising:

cleaning said workpiece, placing a clean beryllium bar in surface engagement with said zirconium workpiece, heating said engaged parts in an atmosphere to a eutectic producing temperature for a period of time, cooling said engaged bar of beryllium and said zirconium substrate, separating said bar and said substrate, repeating the process with the same bar.

4. A method of producing a layer of a titanium-beryllium eutectic on a titanium substrate comprising:

providing a bar of beryllium, providing a titanium substrate, cleaning the surfaces of said bar and substrate, mating said bar with said substrate so that the previously cleaned surfaces are in engagement, heating said bar and substrate in an atmosphere at a temperature in excess of the eutectic melting point for a time sufficient to allow the formation of a titanium-beryllium eutectic layer on said substrate, cooling said bar and substrate to room temperature, separating said bar and said substrate.

5. A method of producing a titanium-beryllium eutectic layer on a titanium substrate comprising the steps of:

providing a titanium substrate having at least one cleaned surface, providing a beryllium strip having at least one cleaned surface, mounting said strip on said substrate in a surface engaging relationship so that cleaned surfaces engage one another, heating said engaged strip and substrate in an atmosphere in a suitable furnace to a eutectic producing temperature for several minutes, cooling said engaged strip and substrate and, removing said strip from said substrate.

6. A method of producing a series of titanium-beryllium eutectic layers on a titanium workpiece, comprising:

cleaning said workpiece, placing a clean beryllium body in surface engagement with said titanium workpiece, heating said engaged parts in an atmosphere to a eutectic producing temperature for a period of time, cooling said engaged beryllium body and said titanium substrate, separating said body and said substrate, repeating the process with the same body.

* * * * *